US006311708B1

(12) United States Patent
Howle

(10) Patent No.: US 6,311,708 B1
(45) Date of Patent: Nov. 6, 2001

(54) FOLDABLE WALKER

(75) Inventor: Edward S. Howle, Hillsborough, NC (US)

(73) Assignee: Kaye Products, Inc., Hillsborough, NC (US)

( * ) Notice: Subject to any disclaimer, the term of this patent is extended or adjusted under 35 U.S.C. 154(b) by 0 days.

(21) Appl. No.: 09/321,806

(22) Filed: May 27, 1999

(51) Int. Cl.[7] ..... A61H 3/04

(52) U.S. Cl. ..... 135/67; 280/641; 280/87.021; 482/68; 297/5; 297/183.5

(58) Field of Search ..... 135/67, 85; 280/87.041, 280/87.021, 250.1, 641, 648; 297/5, 6, 183.5; 482/68

(56) References Cited

U.S. PATENT DOCUMENTS

| | | | | |
|---|---|---|---|---|
| D. 246,036 | | 10/1977 | Thomas . | |
| D. 246,302 | | 11/1977 | Thomas . | |
| D. 268,017 | | 2/1983 | Thomas . | |
| D. 268,404 | | 3/1983 | Thomas . | |
| D. 310,646 | | 9/1990 | Rose . | |
| 3,168,328 | * | 2/1965 | Hill, Jr. | 280/641 |
| 3,840,034 | | 10/1974 | Smith . | |
| 3,945,389 | | 3/1976 | Smith . | |
| 4,045,045 | | 8/1977 | Boucher et al. . | |
| 4,159,110 | | 6/1979 | Dodenhoff . | |
| 4,320,817 | * | 3/1982 | Knoke et al. | 297/59 X |
| 4,643,211 | * | 2/1987 | Morris et al. | 135/67 |
| 4,765,644 | | 8/1988 | Bell . | |
| 4,800,911 | | 1/1989 | Endres et al. . | |
| 4,830,035 | | 5/1989 | Liu . | |
| 4,907,794 | | 3/1990 | Rose . | |
| 5,050,862 | | 9/1991 | Saghafi . | |
| 5,201,333 | | 4/1993 | Shalmon et al. . | |
| 5,275,187 | | 1/1994 | Davis . | |
| 5,305,773 | | 4/1994 | Browning . | |
| 5,348,336 | * | 9/1994 | Fernie et al. | 280/641 |
| 5,417,472 | * | 5/1995 | Elvinsson | 297/6 |
| 5,433,235 | | 7/1995 | Miric et al. . | |
| 5,465,744 | | 11/1995 | Browning . | |
| 5,499,856 | | 3/1996 | Sorrell et al. . | |
| 5,529,425 | | 6/1996 | Spies et al. . | |
| 5,579,793 | | 12/1996 | Gajewski et al. . | |
| 5,603,517 | * | 2/1997 | Lorman | 135/67 X |
| 5,605,345 | * | 2/1997 | Erfurth et al. | 135/67 X |
| 5,716,063 | * | 2/1998 | Doyle et al. | 135/67 X |
| 5,800,317 | * | 9/1998 | Accetta | 135/67 X |
| 5,816,593 | * | 10/1998 | Che | 280/87.041 |
| 5,819,772 | | 10/1998 | Pi . | |

OTHER PUBLICATIONS

Kaye Products,Inc., Product Catalogue 1997–1998, pp. 26 and 27.

* cited by examiner

*Primary Examiner*—Winnie S. Yip
(74) *Attorney, Agent, or Firm*—B. Craig Killough

(57) ABSTRACT

A walker having a frame which provides two front legs. Two rear legs are attached to the frame. A cross member provides support for the device which is supplemented by a link. Each of these structural members is in a pivotal relationship with the remaining members so the walker may be folded for storage. The cross member and link provide bracing for structural integrity, but are also incorporated into the folding structure. The optional seat is also in a pivotal relationship with the device. The seat prevents the walker from being folded while it is being used as a walker.

14 Claims, 4 Drawing Sheets

FOLDABLE WALKER

FIELD OF THE INVENTION

This invention relates to walkers which assist walking.

BACKGROUND OF THE INVENTION

Walkers are used by children and adults. These devices are typically used by persons who have some ambulatory ability, but who need assistance with support or balance. Walkers typically have frames which the user grips with his or her hands. The walker, in combination with the strength provided by the arms and torso, provides balance to the user, and allows the user's upper body strength to be used in walking.

Walkers known and used in the prior art may, or may not, have two or more wheels. The wheels may be designed to roll in one direction only. Some walkers may be folded for storage, and some walkers provide seats. It is desirable to have a walker which is as light in weight as possible, but which is also sufficiently strong, since a collapsed walker is extremely undesirable. It is also desirable to have a walker which may be folded for ease of storage, since a walker may have an overall foot print which is of substantial size, and space in hospital rooms and nursing home rooms is usually at a premium. However, the folding structure typically adds weight to the device, and is contrary to the goal of having a device of light weight. Accordingly, one of the goals of the present invention is to incorporate a support structure into a folding structure to increase strength without undue addition of weight.

It is also desirable that the device not be capable of folding, while being used as a walker. It is also desirable to provide a seat which allows to user to be seated on the walker, in the event the user becomes weary, or otherwise desires to sit or rest. A goal of the present invention is to use the seat frame as a safety device which prevents the walker from being folded while it is in a position for walking, due to the location and structure of the seat. The same frame may be used for this purpose, even if it does not incorporate a seat.

SUMMARY OF THE INVENTION

The present invention is a walker having a frame which provides two front legs. Two rear legs are attached to the frame. A cross-member provides support for the device which is supplemented by a link. Each of these structural members is in a pivotal relationship with the remaining members.

The construction of the walker according to the present invention may be folded for storage. The cross-member and link provide bracing for structural integrity, but are also incorporated into the folding structure. The optional seat is also in a pivotal relationship with the device, so that it may be folded down for use. However, when pivoted so that the device can be used as a walker, the seat prevents the walker from being folded, thereby acting as a safety device for inadvertent folding of the walker while it is being used as a walker. Also optional is a frame which does not support a seat, but when pivoted, prevents the walker from being inadvertently folded while in use.

DETAILED DESCRIPTION OF THE PREFERRED EMBODIMENT

Figure 1:
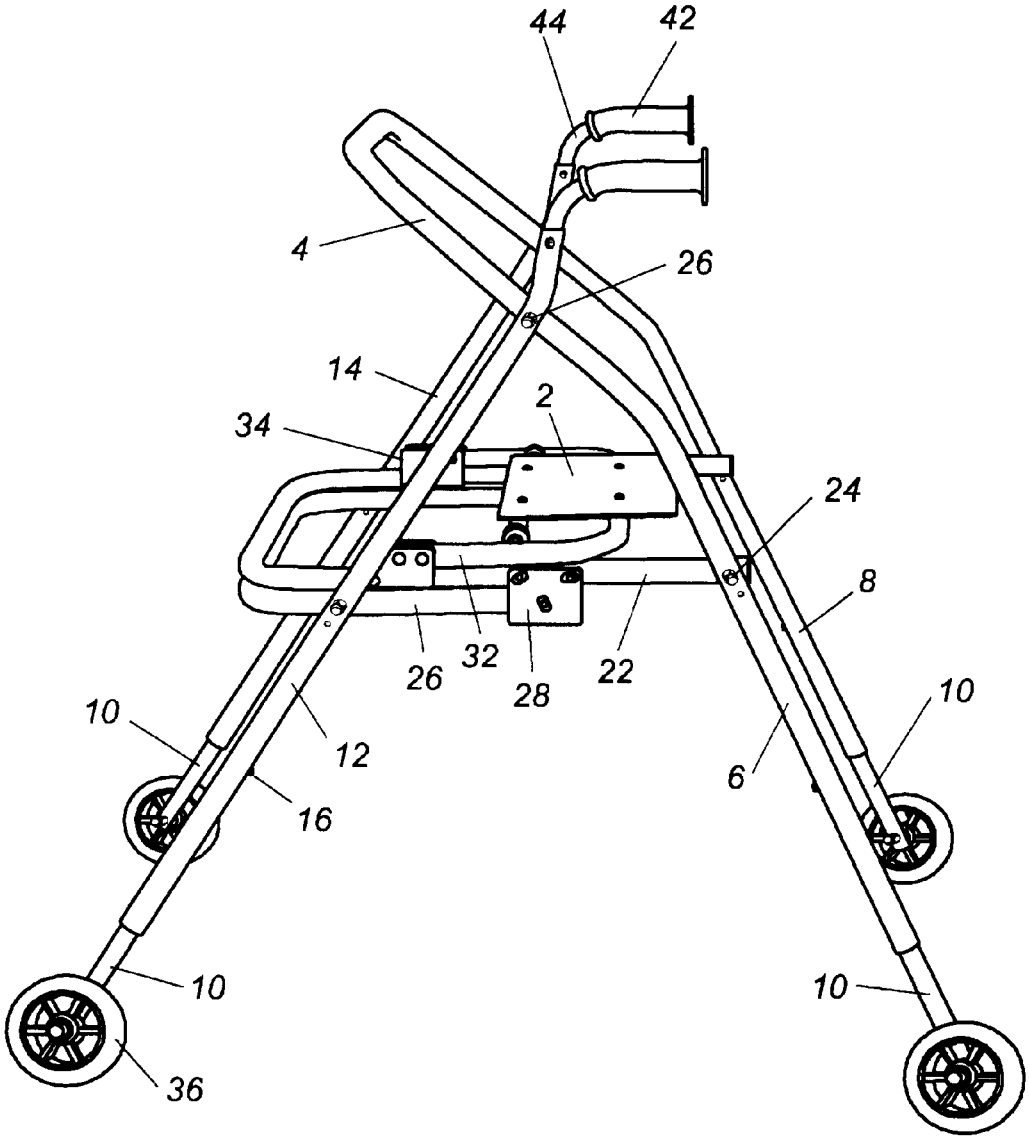
FIG. 1 is a perspective view of the walker.

Referring now to the drawing figures, FIG. 1 shows the walker with the seat 2 in position for use of the device as a seat. The device has a frame 4 which is generally U-shaped. The frame has a first front leg 6, and a second front leg 8. The front legs as shown include extensions 10 which allow the overall height of the device to be adjusted according to the user's needs.

A first rear leg 12 is attached to the frame in a pivotal relationship with the frame. The first rear leg corresponds to the first front leg. A second rear leg 14 is also in a pivotal relationship with the frame. The second rear leg corresponds to the second front leg. Each of the rear legs has a leg extension 10 to allow the overall height of the device to be adjusted according to the user.

The front and rear leg extensions each telescope within the frame, and may be provided with adjustment means which secure the extensions in place during use. As shown in the drawing figures, the adjustment means is a spring loaded pin 16 which is positioned in one of multiple spaced apart orifices 18 provided on each of the legs. Other means of securing telescoping devices may be used to secure the extensions.

Figure 5:
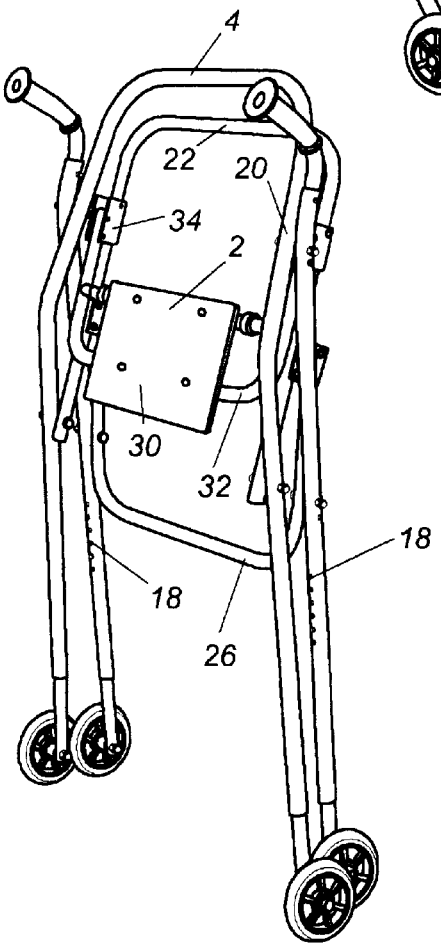
FIG. 5 demonstrates the device in a folded position.

It is preferred that the distance from the pivot point 20 to the furthest edge of the wheel of the front leg be equal to the distance from the pivot point to the furthest edge of the wheel of the rear leg. This position allows the device to stand when folded. FIG. 5.

Figure 2:
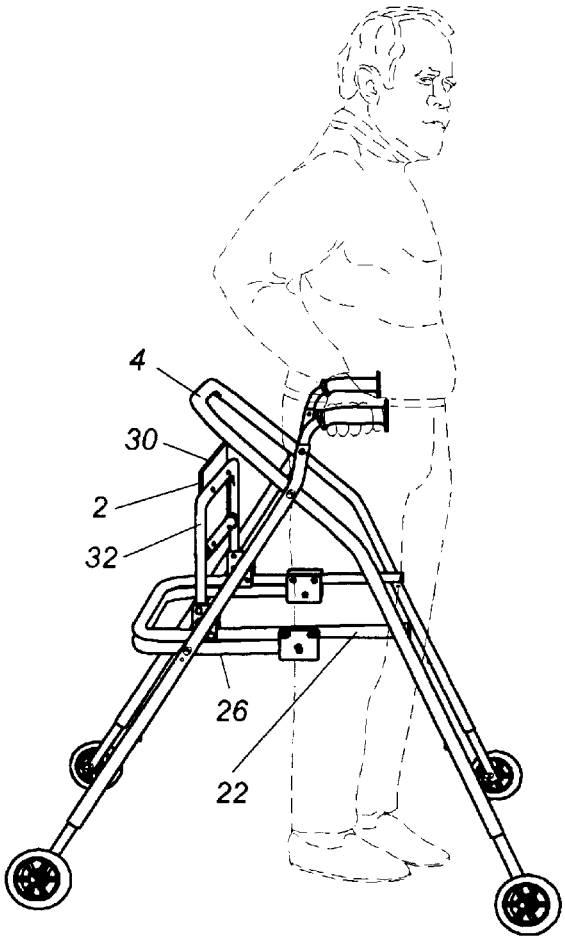
FIG. 2 is a perspective view of the walker reduced in size in from FIG. 1 and demonstrating the device being used as a walker.

A cross member 22 is pivotally attached to the frame. As shown in the drawing figures, the cross member is generally U-shaped, and is pivotally attached 24 near each end or point of the "U" to the first front leg and second front leg, respectively. The cross member is attached to the frame below the point of pivotal attachment of the rear legs to the frame. Generally, the U-shape of the cross member allows a user to stand within the walker as shown in FIG. 2. The cross member does not impede ingress, egress, or use of the walker. The U-shaped cross-member provides substantial bracing and structural integrity without interfering with the use of the device, while at the same time participating in the folding structure of the device. The cross-member extends behind the rear legs to permit the user to walk within the walker without impediment.

A link 26 is also provided. As shown in the drawing figures, the link is generally U-shaped and is connected along a length of the points of the "U" to the first rear leg and second rear leg, respectively. The link, as shown, is positioned directly below the cross member, excepting that the points of the "U" of the link are shorter than the points of the "U" of the cross member. The structure allows the link, in combination with the cross-member, to provide structural integrity and stability for the device without interfering with ingress, egress, or use of the device. The link extends beyond the rear legs to permit the user to stand and walk within the walker without impediment. The pivotal attachment of the link to both the rear legs and to the cross-member allows the link to participate in the folding of the device. The pivotal relationship between the link and the cross-member, as shown in the drawing figures, is achieved through the use of plates 28 which provide superior strength to direct mounting of the tubular material from which the device is preferred to be constructed.

Figure 3:
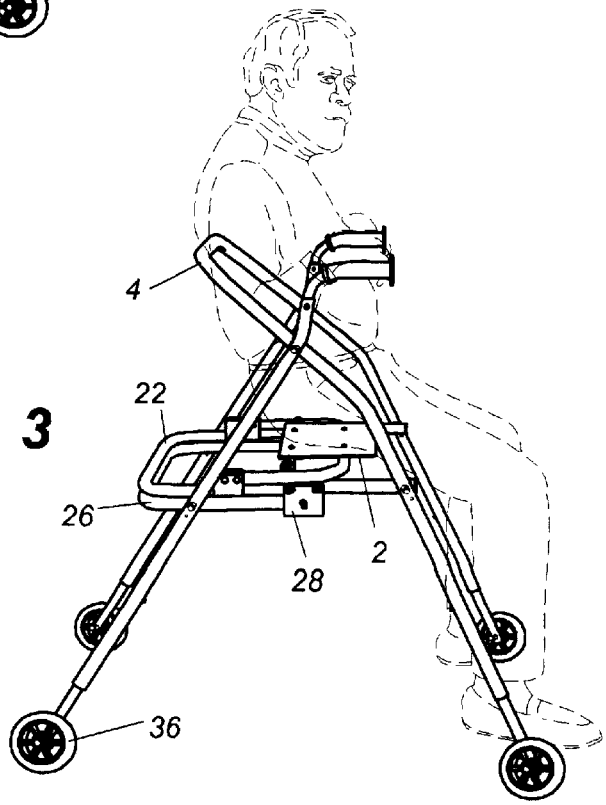
FIG. 3 is a perspective view of the walker reduced in size in from FIG. 1 and demonstrating the device being used as a seat.
Figure 4:
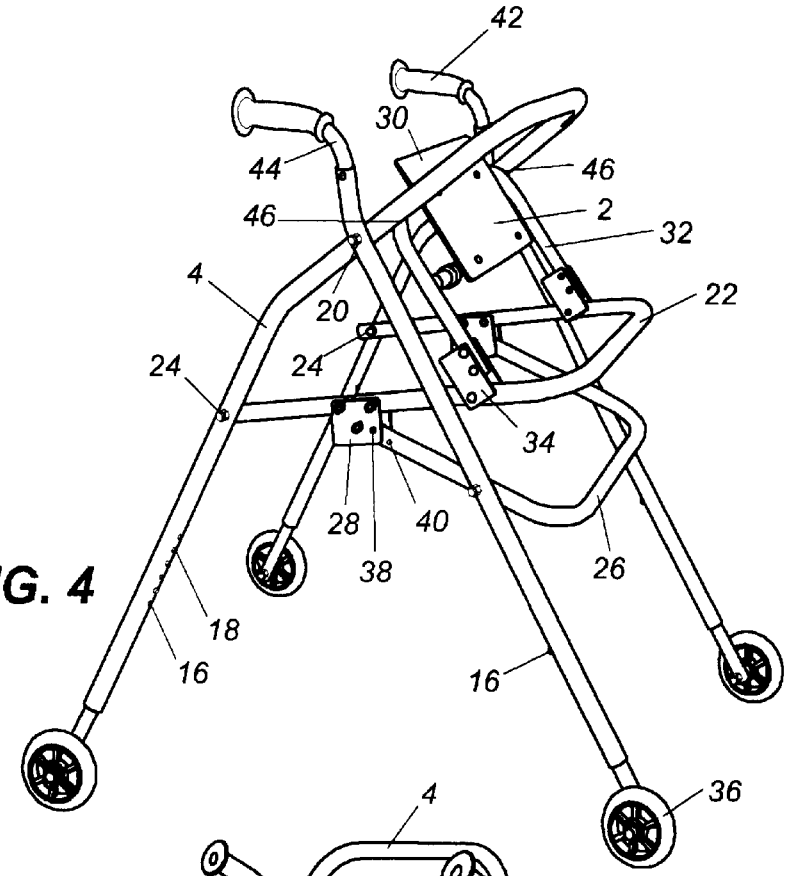
FIG. 4 shows the device in a partially folded position.

A seat 2 is provided. The seat structure of the preferred embodiment comprises a seat panel 30 which is particularly rectangularly-shaped plane. The seat panel is mounted to a seat frame 32, which is generally U-shaped with a support connecting the points of the U for additional strength and support for the seat panel. The seat frame is pivotally attached to the cross-member, and as shown, is pivotally attached using plates 34. As shown, the seat pivots to a generally vertical position and out of the way for ingress and egress and use of the walker. FIG. 2. The seat device pivots down toward the front legs of the device, filling the spot where the user stands and walks when the device is used as a walker. When the seat is folded down, a seat is provided for the user. FIG. 3. The seat frame and seat occupy the opening between the legs when the seat frame and seat are folded to a generally horizontal position. As the seat frame and seat are pivoted to a more vertical position for standing and walking, the device cannot be fully folded by moving the front and rear legs together, since the seat assembly strikes the frame. FIG. 4. The top of the U-shaped frame provides back support for a seated user.

In the preferred embodiment, the wheels 36 of the device roll one way only. The wheels will not roll when pushed in a direction opposite the intended rolling direction. When a user sits or stands in the device, as shown in FIG. 3, there is a tendency to push the device to the rear of the person by means of the user's legs. However, the wheels will not roll in this direction. Neither the action of entering the device, nor the tendency of the user to push back with the legs, will cause the device to roll. While the device will roll in the opposite direction, the device will not tend to move in that direction without an intended, rather than inadvertent, action. The device may use pegs in place of some, or all, of the wheels.

As the link and cross member pivot relative to each other, the link pivots relative to the rear legs, and the cross member also pivots relative to the front legs. FIG. 4. The front legs and rear legs also pivot relative to each other. The link and cross member are substantially abutting, as shown in FIG. 1, and separate as they are pivoted to the position shown in FIG. 4, and are at maximum separation as the device is fully folded, or approximately fully folded, as shown in FIG. 5. FIG. 4 shows that, with the seat frame in the raised position, the frame strikes the walker frame at point 46 on each side, preventing inadvertent folding of the walker with the seat frame in the raised position. It will perform this function even if the seat frame is present without a seat.

Other features of the device include handle bars 44 with grips 42 which extend from an upper portion of the first rear leg and second rear leg, respectively. The handle bars may be provided with adjustment means to raise or lower the handle bars.

In FIGS. 1 through 4, both the link and the cross-member are U-shaped members. This provides structural rigidity. In particular, this embodiment prevents side to side wobble of the rear legs. Rigidity may be obtained in other ways.

Figure 6:
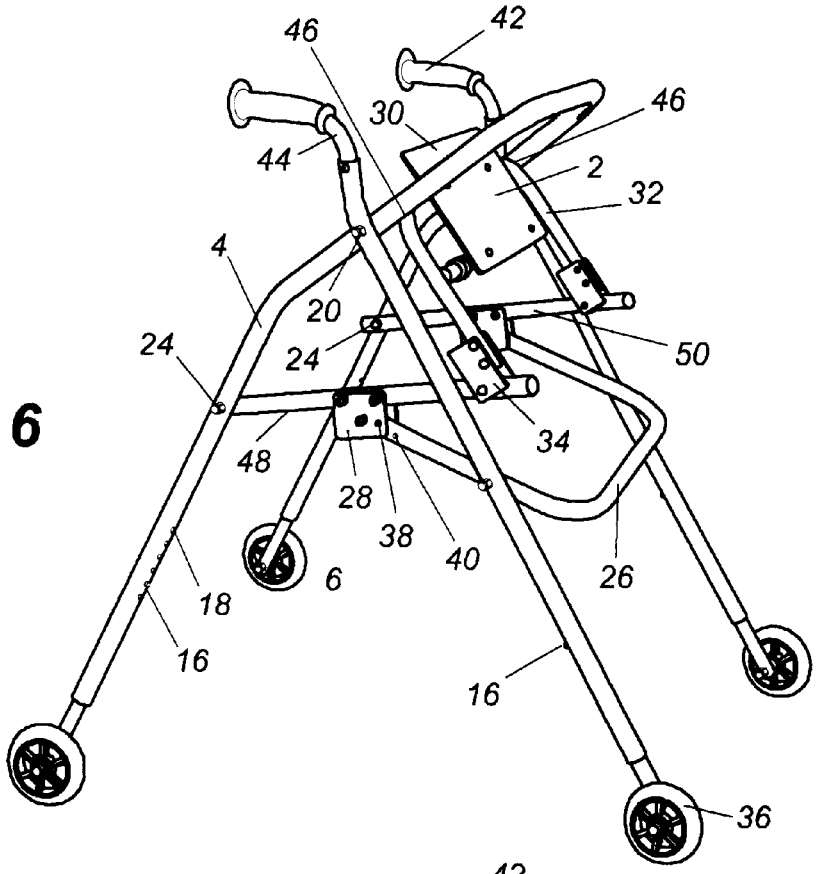
FIG. 6 shows an additional embodiment of the device in a partially folded position.

FIG. 6 is a partially folded view of the walker in which there is a cross-member 48 on one side corresponding to leg 4, and a separate cross-member 50 on the other side corresponding to leg 6. The link 26 is U-shaped as before, but there is no U-shaped cross-member. Plates 28 and 34 joining the cross-members to the link are sufficiently rigid and long to present sufficient structural rigidity. Other means which prevent side to side motion of the cross-members could be employed to supply adequate structural rigidity.

Figure 7:
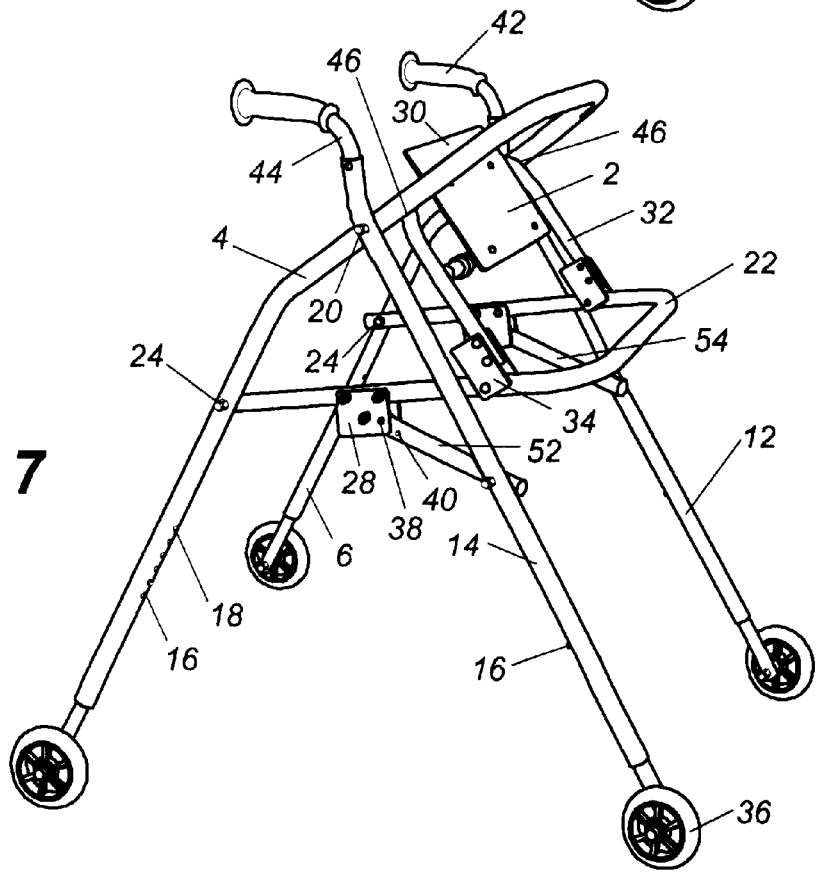
FIG. 7 shows another embodiment of the device in a partially folded position.

FIG. 7 is a partially folded view of the walker in which there is a link 52 on one side corresponding to rear leg 14, and a link 54 on the other side corresponding to rear leg 12. The cross-member 22 is U-shaped as in FIGS. 1–4, but there is no U-shaped link. Plates 24 and 34 joining the links to the cross-member are sufficiently rigid and long to present sufficient structural rigidity. Other means which prevent side to side motion of the cross-members could be employed to supply adequate structural rigidity.

What is claimed is:

1. A foldable walker comprising:

a. a frame which comprises a first front leg and a second front leg;

b. a first rear leg which intersects said frame at an upper portion of said first front leg and is pivotally mounted to said frame;

c. a second rear leg which intersects said frame at an upper portion of said second front leg and is pivotally mounted to said frame;

d. a cross member being pivotally mounted to said first front leg and to said second front leg;

e. a link being pivotally mounted to said first rear leg and said cross member at a first location; and f. a second frame being pivotally mounted to said cross member at a second location spaced from said first location, wherein when said cross member is pivoted relative to said first front leg and said second frame is pivoted generally downwardly, said second frame occupies a space which is between said first front leg, said second front leg and said first rear leg and said second rear leg, and said second frame is positioned immediately above said cross member, and when said second frame is pivoted upwardly from said cross member, said second frame strikes an upper portion of said frame when said first rear leg is pivoted toward said first front leg from a fully extended position.

2. A foldable walker as described in claim 1, wherein said cross member is pivotally mounted to said second front leg, and wherein said cross member extends to said first rear leg, and wherein said cross member bridges a space which is between said first rear leg and said second rear leg when said first front leg is fully extended relative to said first rear leg.

3. A foldable walker as described in claim 2, wherein said cross member extends from said first front leg and said second front leg between said first rear leg and said second rear leg when said first front leg is fully extended relative to said first rear leg.

4. A foldable walker as described in claim 3, further comprising a seat which is mounted to said second frame.

5. A foldable walker as described in claim 2, further comprising a seat which is mounted to said second frame.

6. A foldable walker as described in claim 1, further comprising a seat which is mounted to said second frame.

7. A foldable walker, comprising;

a. a frame which comprises a first front leg and a second front leg;

b. a first rear leg which intersects said frame at an upper portion of said first front leg and is pivotally mounted to said frame;

c. a second rear leg which intersects said frame at an upper portion of said second front leg and is pivotally mounted to said frame;

d. a link being pivotally mounted to said first rear leg; and e. a cross member comprising a first side member, a second side member, and a lateral member wherein said first side member is pivotally mounted to said first front leg below the point at which said frame is pivotally mounted to said first rear leg; said first side member is pivotally mounted to said link at a location spaced from said lateral member; said second side member is pivotally mounted to said second front leg below the point where said frame is pivotally mounted to said second rear leg; said lateral member connects said first side member and said second side member and does not pivot relative to said first side member, and wherein, when said first rear leg is fully extended relative to said first front leg, said lateral member is behind said first front leg so as to provide an opening between said first front leg and said second front leg, said cross member lies substantially parallel above said link, and said cross member is not connected to said first rear leg or to said second rear leg.

8. A foldable walker as described in claim 7, wherein said cross member extends from said first front leg and said second front leg to said first rear leg and said second rear leg when said first front leg is fully extended relative to said first rear leg.

9. A foldable walker as described in claim 8, wherein said link is pivotally mounted to said second rear leg and wherein said link bridges a space which is between said first rear leg and said second rear leg when said first front leg is fully extended relative to said first rear leg.

10. A foldable walker as described in claim 9, further comprising a second frame which is pivotally mounted to said cross member.

11. A foldable walker as described in claim 8, further comprising a second frame which is pivotally mounted to said cross member.

12. A foldable walker as described in claim 7, wherein said link is pivotally mounted to said second rear leg and wherein said link bridges a space which is between said first rear leg and said second rear leg when said first front leg is fully extended relative to said first rear leg.

13. A foldable walker as described in claim 12, further comprising a second frame which is pivotally mounted to said cross member.

14. A foldable walker as described in claim 7, further comprising a second frame which is pivotally mounted to said cross member.

* * * * *